United States Patent [19]

Goldfarb et al.

[11] Patent Number: 4,468,884

[45] Date of Patent: Sep. 4, 1984

[54] MINIATURE TOY VEHICLE DRIVEN AT THREE AXES

[75] Inventors: Adolph E. Goldfarb, 1432 SE. Wind Cir., Westlake Village, Calif. 91361; Delmar K. Everitt, Woodland Hills, Calif.

[73] Assignee: Adolph E. Goldfarb, Northridge, Calif.

[21] Appl. No.: 333,466

[22] Filed: Dec. 22, 1981

Related U.S. Application Data

[63] Continuation-in-part of Ser. No. 121,645, Feb. 14, 1980, Pat. No. 4,306,375.

[51] Int. Cl.[3] ..... A63H 17/00

[52] U.S. Cl. ..... 446/462

[58] Field of Search ..... 46/251, 253, 254, 206, 46/201, 202, 219, 217, 252, 256, 255, 210, 211, 212, 257; 180/22

[56] References Cited

U.S. PATENT DOCUMENTS

| | | | |
|---|---|---|---|
| 1,471,295 | 10/1923 | Thorp | 180/22 X |
| 2,311,123 | 2/1943 | Osborne | 46/201 |
| 2,786,540 | 3/1957 | Sfredda | 46/206 X |
| 3,038,275 | 6/1962 | Curci | 46/105 X |
| 4,326,355 | 4/1982 | Watanabe | 46/251 X |

FOREIGN PATENT DOCUMENTS

| | | | |
|---|---|---|---|
| 816816 | 8/1951 | Fed. Rep. of Germany | 46/206 |
| 521348 | 5/1940 | United Kingdom . | |
| 841659 | 7/1960 | United Kingdom . | |
| 893768 | 4/1962 | United Kingdom . | |
| 1049164 | 11/1966 | United Kingdom | 46/201 |
| 1459119 | 12/1976 | United Kingdom . | |
| 2024633 | 1/1980 | United Kingdom . | |

*Primary Examiner*—Mickey Yu

*Attorney, Agent, or Firm*—Romney Golant Martin & Ashen

[57] ABSTRACT

An electrically self-powered miniature toy vehicle having three or more driven axles, and being capable of climbing over rough terrain and obstacles as well as up steep inclines. In a preferred form, the vehicle in the form of the cab of an 18-wheeler truck is only slightly longer than two AA penlight batteries placed end-to-end and the chassis is less than twice the width of such batteries. The vehicle has a small electric motor with a double-ended shaft and a gearing system which drives the three or more axles. The motor and gearing system are located along one side of the chassis while the batteries are located along the other side of the chassis. The batteries are located approximately the same height as the wheels of the vehicle, and laterally adjacent to the motor. The frame, the motor and the batteries do not protrude any appreciable distance below the level of the axles in the area between the front and rear wheel. In a preferred form there is one front wheel axle and two rear wheel axles.

25 Claims, 13 Drawing Figures

FIG. 5
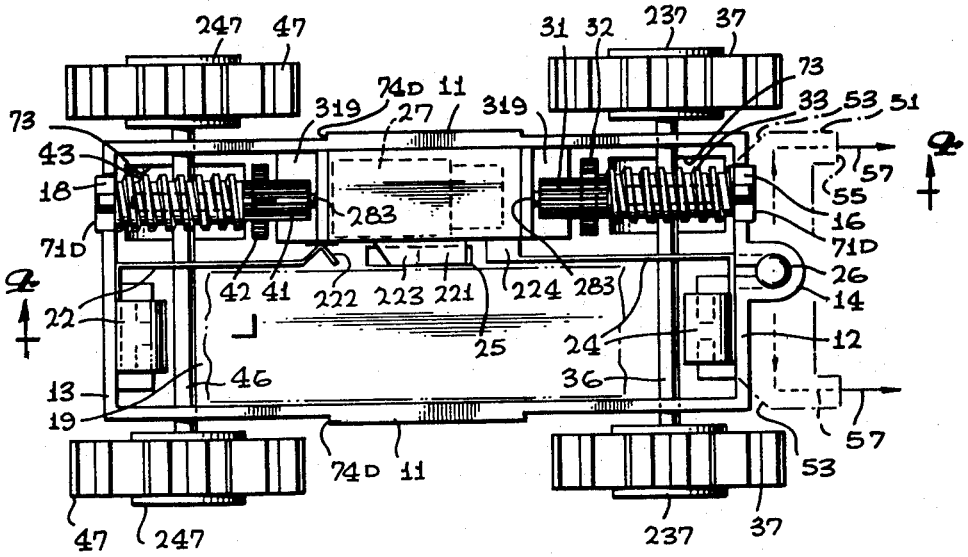
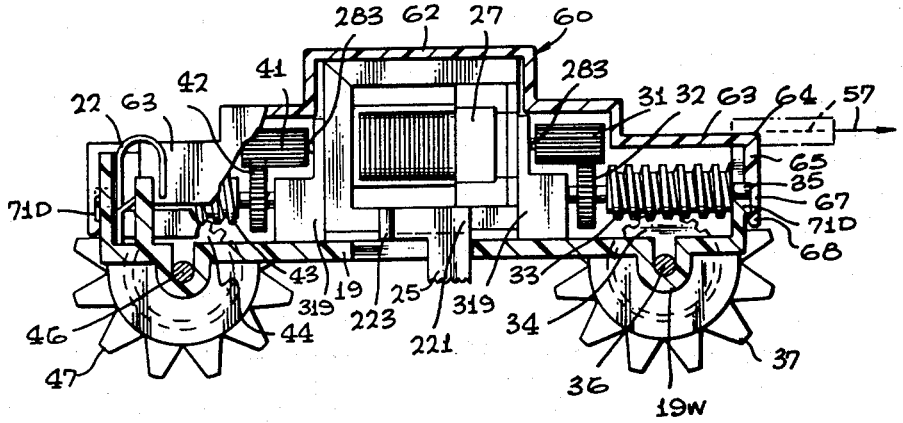
FIG. 6

MINIATURE TOY VEHICLE DRIVEN AT THREE AXES

RELATED APPLICATIONS

This application is a continuation-in-part of U.S. patent application Ser. No. 121,645 filed Feb. 14, 1980 now U.S. Pat. No. 4,306,375.

BACKGROUND OF THE INVENTION

This invention is in the field of toy vehicles, and particularly relates to self-powered miniature toy vehicles capable of negotiating steep and irregular surfaces.

An electrically self-powered miniature four-wheel drive toy vehicle is disclosed in applicant's co-pending application Ser. No. 121,645 filed Feb. 14, 1980 of which this application is a continuation in part. The vehicle of that application has been an extremely successful commercial product. The present application is directed to a modification of that structure. The toy vehicle of that co-pending application had a single AA penlight battery which powered a small electric motor with a double-ended shaft. Each end of the shaft drove, through a gear train including a worm and worm gear, one of the two axles (front and rear) of the vehicle.

A modified embodiment of the vehicle is presented by this application. It includes a third axle having a worm gear driven by a worm which is in turn driven from an end of the motor shaft. The vehicle chassis is lengthened accordingly and accommodates a second AA battery aligned end to end with the first battery so as to not increase the width of the chassis. This provides more power for the same size motor and can develop about twice the RPM. The gear ratios in this embodiment have been changed accordingly. By driving all three axles you are virtually assured that there will be driven wheels in contact with the supporting surface at all times; this is particularly true going over hills and the like. The third axle also adds traction to give more pulling power, ability to handle steeper grades, etc. Improved articulated connection means are also provided for releasibly attaching this embodiment in the form a truck cab to a truck trailer section.

SUMMARY OF DISCLOSURE

FIGS. 1 through 8 disclose the toy vehicle of prior co-pending application Ser. No. 121,645. The modified form of toy vehicle being claimed by this application is shown in FIGS. 9 through 13.

The toy vehicle of FIGS. 9 through 13 is an electrically self-powered miniature toy vehicle having three axles, all of which are driven. In the illustrated form there is one front axle and two rear axles. The vehicle is provided with a small electrical motor which is disposed at one side of the chassis and is powered by two 1 ½ volt AA penlight batteries disposed end-to-end at the other side of the chassis. The motor has a shaft which extends both forwardly and rearwardly; a worm on a front gear train shaft engages and drives a worm gear on the front axle; and a pair of worms on a gear train shaft engage and drive a pair of worm gears on the rear axles. Using the same motor as for the two-axle one battery version of the device, the provision of two batteries permits the RPM output to approximately double. Driving all three axles tends to insure that there will almost always be driven wheels in contact with the supporting surface without regard to the irregularity of the supporting surface and the orientation of the vehicle with regard to that surface. This permits the vehicle to climb up and over practically anything.

In the illustrated preferred form, the vehicle has its major weight components, i.e. the batteries, the motor, the gearing, positioned to provide weight in a generally balanced and relatively low arrangement, while also providing adequate ground clearance in the area between the front and rear wheels. More particularly the batteries are arranged along one side of the chassis while the motor and gear train are arranged along the other side of the chassis. The motor is positioned generally intermediate the front and rear ends of the chassis. The batteries, motor, gear train and wheels are generally at a common relatively low level to provide a low center of gravity. Further the frame, the motor and the batteries do not protrude any appreciable distance below the level of the front and rear axles in the area between the front and rear wheels, to provide the desired ground clearance.

In a preferred form, the vehicle is a truck/cab which is designed to attach to a truck/trailer. Improved connection means are provided between the cab and the trailer to permit vertical or up-and-down articulation.

The foregoing principles and features of our invention may be more readily understood and visualized from the detailed description which follows, together with reference to the accompanying figures, of which:

BRIEF DESCRIPTION OF THE DRAWINGS

FIGS. 4 and 5 are respectively elevation and plan views of the FIG. 1 preferred embodiment, FIG. 4 being partly in section and taken along the dogleg line 4—4 in FIG. 5.

DETAILED DESCRIPTION OF THE PREFERRED EMBODIMENTS

Figure 1:
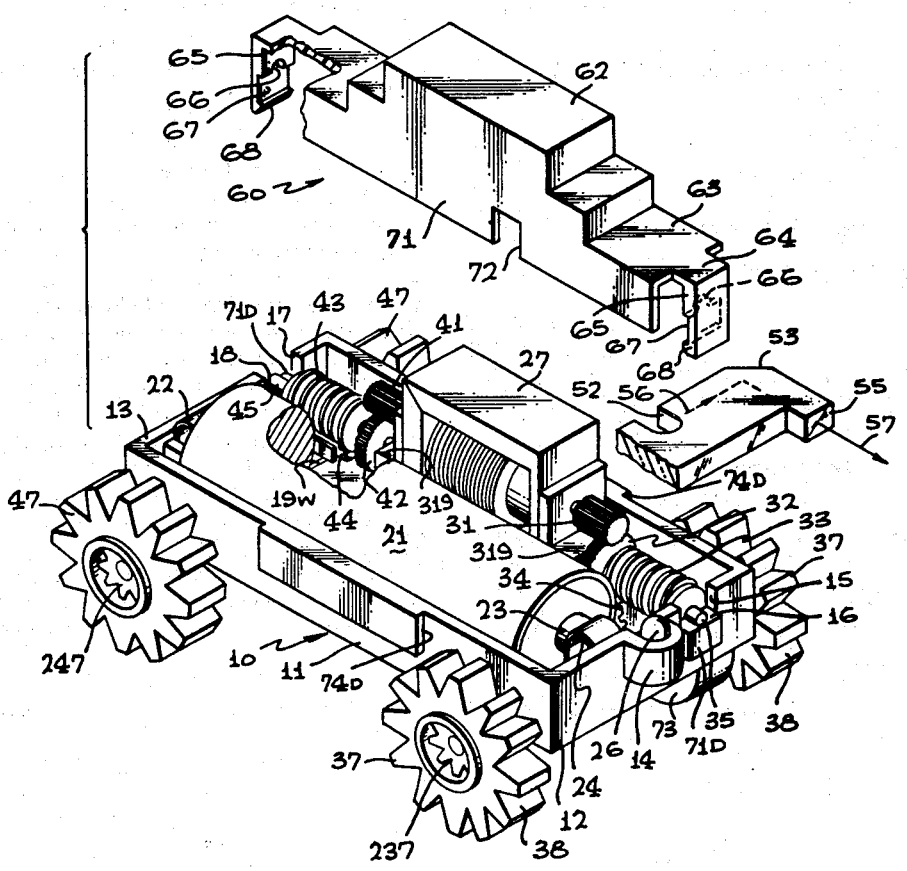
FIG. 1 is a perspective view of a toy vehicle which is a preferred embodiment of our invention, shown without a scale-model vehicle body in place.
Figure 8:
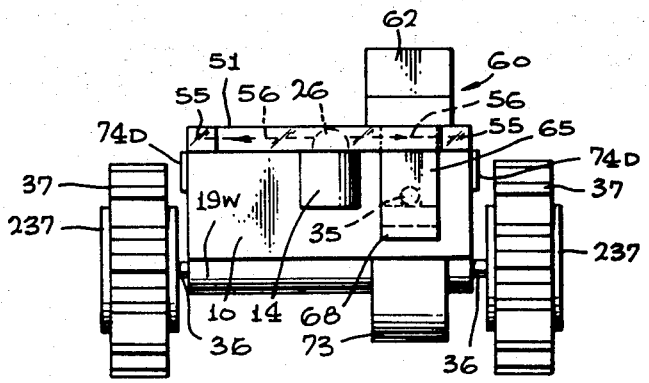
FIG. 8 is an additional elevation, taken from in front of embodiment of FIGS. 1 through 5.

Embodiments of application Ser. No. 121,645:

As shown in FIGS. 1, 4 and 5, a preferred embodiment of our invention is built in and around a chassis 10 consisting of upstanding left and right side walls 11, front end wall 12 and rear end wall 13, all erected about the periphery of an extended horizontal floor 19. The front end wall 12 has a forward protrusion 14 which supports and contains functional connections for a small light bulb 26, and which also supports a transparent light distributor 51 to be described in detail below.

The front end wall 12 also has a generally rectangular slot 15, 16 formed in it; and the rear end wall 13 has a similar slot 17, 18—both slots being provided for a purpose to be described.

The chassis 10 serves both as a frame to support and as a partial enclosure to conceal and protect the power source and train.

Mounted below the chassis for rolling rotation with respect to it are two mutually parallel but spaced-apart axles, an axle 36 near the front and an axle 46 near the rear of the chassis. Secured to the ends of these two axles 36 and 46 are respective pairs of wheels—front wheels 237 and rear wheels 247, with corresponding tires 37 and 47, which are thus in effect mounted to the frame for rolling rotation about respective mutually parallel but spaced-apart axes (the centerlines of the axles 36 and 46), one such axis being in front of the other.

Mounted atop the chassis floor 19 at a position between the two axles (or wheel rotation axes) is an electric motor 27. The motor 27 is located against one of the side walls 11, and oriented so that its driveshaft 283 (FIGS. 4 and 5) is perpendicular to the two-wheel-rotation axes. This motor is of a type whose driveshaft extends both fore and aft from the motor housing. The motor 27 is secured against longitudinal motion by two blocks 319, which are integral with the chassis floor 19 and the adjacent side wall.

Mounted to the two ends of the motor driveshaft 283 are respective drive pinions 31 at the front and 41 at the rear, which are firmly secured for rotation with the driveshaft.

Below the pinions 31 and 41 and meshed with them are respective spur gears 32 and 42, which rotate on corresponding shafts 35 and 45 oriented parallel to the driveshaft. The spur-gear shafts 35 and 45 are each journalled at one of their respective ends into one of the motor blocks 319, and at the other of their respective ends into the corresponding end wall 12 and 13, in a manner to be detailed below. Sharing the spur-gear shafts 35 and 45 with the spur gears 32 and 42, and firmly secured to those spur gear shafts to rotate with them, are respective worms 33 and 43.

Below these worms 33 and 43, and oriented and disposed to mesh with them, are respective worm gears 34 and 44—each oriented to rotate about axes parallel to the axes of wheel rotation. The worm gears 34 and 44 and the respective wheel pairs 237 and 247 are mounted conaxially (that is, together on the same respective shafts 36 and 46). The gears and wheels are fixed to their corresponding axles, for rotation in common; thus each of the worm gears 34 and 44 drives a respective pair 237 or 247 of wheels.

Thus the wheels may be driven by a symmetrical power train having but two stages and yet providing very high mechanical advantage between the motor driveshaft and the axles, and occupying a narrow space along one side of the chassis 11—and thus leaving the greater width of the chassis for a "penlight" battery 21 (whose positive pole appears at 23), and the appropriate electrical connectors 22 and 24.

From the fact that the dry-cell battery 21, appearing in FIG. 1 is only a size-AA penlight type, the remarkably small overall size of the vehicle may be seen dramatically. Yet, due to the simplicity of the novel drive train, it is not necessary to use highly miniaturized or high-precision gears.

A miniature scale-model vehicle body (such as 74 in FIG. 2) is fitted to the chassis 10, and held on by left and right detents 74D formed in the outsides of the chassis side walls 11. The body 74 snaps on and off to permit easy changing of the battery 21. The body style typically is derived from two or more real vehicle bodies as a composite, with blending features supplied by the scale-model designer.

To obtain excellent traction, the tires 37 and 47 are made of rubber foam or plastic foam. We prefer to use a foam whose cell structure is open to the air—particularly about the periphery of the tire, where it comes in contact with the surface on which the vehicle is operating. We consider this type of material optimal, but other soft pliable material may be substituted if preferred. Best traction also requires that the tires be configured with extremely exaggerated or pronounced tread-cut patterns such as 38.

Some details of the construction of this preferred embodiment of our invention include protective drive-gear wells, such as the rear well 73, encasing the worm gears 34 and 44 respectively, and drive-mechanism cover 60. The drive-mechanism cover 60 includes an elevated section 62 to accommodate the motor 27, lower sections 63 at front and rear to cover the respective worms, 33, 43, and worm gears 34, 44, and intermediate cover sections of intermediate height to cover the respective pinions 31, 41. The cover 60 also has a side wall 71 which isolates the drive mechanism from the battery-mounting area, while providing an electrical connection path via the slot 72.

The narrowed end sections 64 of the cover 60 terminate in vertical sections 65, with thinner portions 67 and hooks 68. These vertical end sections snap over detents 71D formed in the respective end walls 12 and 13 of the chassis. In particular the detents 71D are formed as protruding ledges at the bottoms of the slot 15, 16 in the front wall 12 and the slot 17, 18 in the rear wall 13. The thicker upper portions 65 of the vertical end sections of the cover 60 fit into the respective slots 15, 16, and 17, 18.

It may now be noted that the forward end of the forward worm shaft 35 rests in a half-journal formed in the horizontal bottom surface 16 of the slot 15, 16. Likewise the rearward end of the rear worm shaft 45 rests in a half-journal formed in the horizontal bottom surface 18 of the rear slot 17, 18. The upper halves of these two journals are provided by the snap-on end sections 65 of the drive cover 60. The two upper half-joirnals are visible at 66 in FIG. 1.

Though below the chassis floor proper 19, the axles 36 and 46 are within the chassis enclosure by virtue of axle wells 19W (FIG. 4), which extend to the two sides of the chassis and serve as axle bearings.

Figure 2:
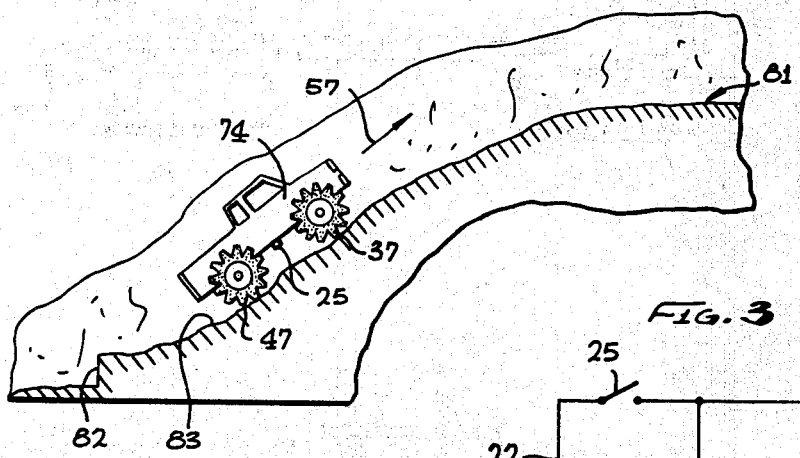
FIG. 2 is a generalized elevation of the embodiment of FIG. 1 in use on an accompanying toy hill, particularly illustrating the climbing capabilities of the toy and also illustrating the appearance of the toy with a scale-model vehicle body in place.
Figure 3:
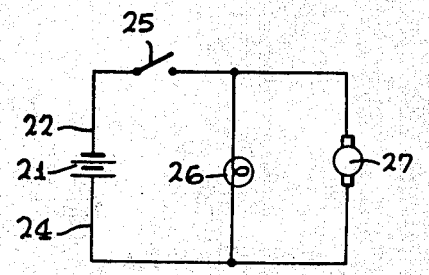
FIG. 3 is a schematic diagram of the electrical circuit employed.

As is apparent from FIG. 3 the circuitry of the toy is generally conventional: battery 21 applies power through contacts 22 and 24 (also see FIG. 1) and switch 25 (also see FIG. 2) to the light bulb 26 and motor 27 in parallel. FIG. 5 shows that the metal contacts 22 and 24 are extended along the side of the battery to respective metallic contacts 222 and 224 which engage appropriate contact points on the motor 27. The user may turn off the motor and light by operating the plastic switch handle 25 (FIGS. 4 and 5) rearward. The inclined-plane surface 223, defined on the upper body portion 221 of the switch handle 25, then forces the angled contact 222 away from the rotor 27.

FIG. 3 points up the fact that only a single light bulb is used, though the toy gives the appearance of having two headlamps. This effect is obtained by providing a shallow transparent "light distributor" 51, advantageously polished in some areas, which has a cutout 52 for nearly encircling the lamp 26, and which rests on the projection 14 mentioned earlier. The distributor 51 has angled and polished outer corners 53 for intercepting light rays 56 leaving the bulb in opposite directions and redirecting such rays forward as at 57 through projections 55. While the rear of the light distributor 51 rests upon chassis projection 14, the projections 55 of the distributor itself are engaged with apertures (not shown) in the front of the scale-model vehicle body 74 (FIG. 2). The apertures in the body 74 thus support the front end of the light distributor 51 by its projections 55, while at the same time permitting the forward-directed light rays 57 to pass forward through the end faces of the projections 55 and through the apertures themselves. Thus the "headlights" at the front of the vehicle glow, as suggested at 57 in FIG. 2. It will be apparent that with suitable coloration it would be possible similarly to provide the effect of taillights.

Taking the distance between axles 36 and 46 as compatible with the dimensions of the model vehicle body 74—that is to say, assuming that the axles 36 and 46 are spaced apart by a distance which is correct for the scale of the model body 74—it may now be asked how the scale of the tires 237, 247 compares with the scale of the body and wheelbase. It will be apparent from FIG. 4 that the tires 237 and 247 are substantially "overscale'-'—that is, oversize with respect to the otherwise consistent model body and wheelbase. In fact we have found that making the body 74 at roughly a 56:1 scale and the tires 237 and 247 overscale by about a factor of two, or at least by a factor exceeding about 1.5, results in producing relatively extreme "ground" clearance both between the wheels and fore and aft of the wheels. Scale-model bodies in the range from about 45:1 to about 60:1 would also be suitable. As a result, and in combination with the other features described herein, the toy is able to clamber over objects substantially higher than its front axles (that is to say, taller than the tire radius), as suggested by the vertical step 82 in FIG. 2 —and generally to perform in such an outlandish fashion as to lend the toy tremendous appeal and fascination. The mere size of the tires alone imparts a droll appearance which adds to the appeal even when the vehicle is stationary.

Figure 7:
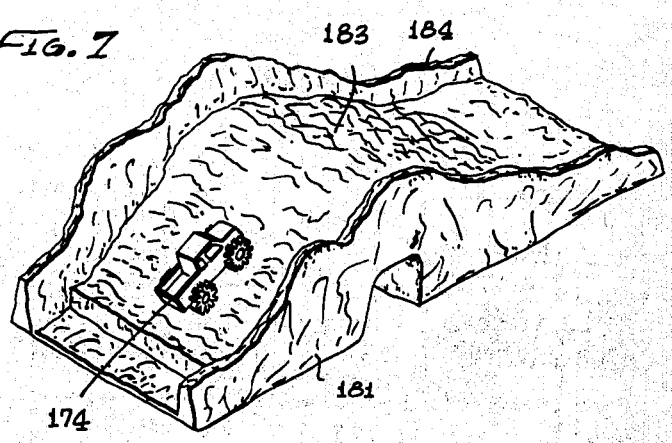
FIG. 7 is a perspective view of a toy "mountain" for use with the toy vehicle, showing more particularly the practical features of a climbing surface to be supplied with the vehicle than does FIG. 2.

Due to the open foam cells of the tires, and the very pronounced tread, the vehicle can find a grip on all but the slipperiest surfaces, even on very steep grades; and due to the high mechanical advantage of the drive train will climb any surface it can rest on and grip. We have found that the preferred embodiment illustrated in FIG. 1 can rest on and grip surfaces of virtually any substance at grades up to about 30°, and with surfaces of high-traction substance such as styrofoam it can operate at grades up to about 40° is that the weight of the vehicle is centered at a point very nearly above the rear wheel axle, so that the vehicle is subject to tipping over backward when it bounces over a small bump. The trade at point 83 of FIG. 2 is approximately 40°, to illustrate the extreme capability of the toy vehicle. A climbing surface such as 81 in FIG. 2 is advantageously supplied with the toy vehicle, a more practical version appearing in FIG. 7.

There the "mountain" 181, advantageously made of styrofoam (or other high-traction material), has a steep and irregular climbing surface 183 which is of limited width, for ease of packaging, and is provided with very steep ridges 184 (too steep for the toy 174 to climb), to restrain the toy from falling over the side edges of the climbing surface. In view of the climbing capabilities of the vehicle, effective grades at some parts of the climbing surface 183 should preferably exceed 30° approach 40°. By "effective grades" we mean the angle of the vehicle to the horizontal, when placed on the surface 183; this definition is useful because the surface 183 is irregular, and the grade over a particular distance smaller than the vehicle wheelbase may exceed 30° or even 40°.

For the preferred embodiment of FIG. 1 we use a motor whose unloaded rotational speed is 3,000 to 10,000 revolutions per minute. The motor of course slows down when the vehicle is climbing a steep grade. We provide a 2:1 gear ratio between the pinion and spur gears 31, 32 and 41, 42; and a further step-down of 20:1 or greater (up to about 25:1) between the worm and worm gear, for an overall reduction or mechanical advantage between 40:1 and 50:1. We believe that the drive train illustrated is optimal for production in ordinary plastic materials. A single-step plastic drive in which the worms were driven directly on the motor driveshaft ends was found unsatisfactory in operation: with a 40:1 or 50:1 mechanical advantage the necessarily finer worm and worm gear could not be held together properly in assembly. Upon impact of the toy vehicle with an obstacle, the worm would bend or otherwise jump out of engagement with the worm gear. Plastic parts could not economically be molded closely enough to make such a system commercially feasible.

Figure 6:
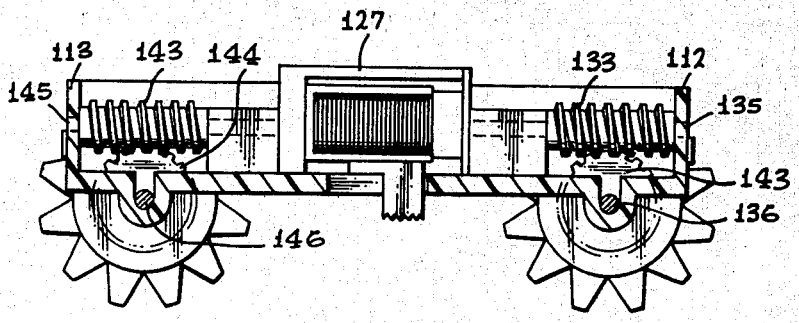
FIG. 6 is an elevation of the driven train only, for an alternative embodiment.

However, we believe that it is possible to use such a system under different performance or economic assumptions to obtain a sucesseful toy. For example, if the cost of the unit can accommodate use of certain critical drive parts made from metal, or if less extreme hill-climbing ability can be accepted so that the driveshaft-to-axle mechanical advantage need be only 20:1 or 25:1, or if provision is made for cushioning the drive mechanism against accepting the complete shock of encountering an obstacle, then the single-step drive system should be usable. This system is shown in FIG. 6.

As there illustrated, the motor 127 driveshaft ends are lower on the motor profile, and directly carry worms 133 and 143. (If preferred, the motor shaft could be higher than shown in FIG. 6, and the worm gear made larger—with an appropriate change in the pitch of the worm to maintain the same reduction.) The motor driveshaft ends 135 (at the forward end) and 145 may be journalled directly in the chassis walls 112 and 113, or provided with suitable bushings (not shown) as appropriate.

The possibly finer-toothed respective worm gears 134 and 144 of course mesh with the worms 133 and 143 generally as in the preferred embodiment previously discussed, driving respective axles 136 and 146 and the corresponding wheels and tires.

The modified embodiment of FIGS. 9 through 13 is in general similar to the construction of the embodiments of FIGS. 1 through 8. In general terms, there is an additional rear axle with a worm gear, and the rear worm shaft is extended and provided with an additional worm that meshes with that worm gear. Further, the motor is located forwardly immediately behind the front wheel axle. This accommodates the desired external configuration of a truck cab and further provides additional weight at the front end of the vehicle. The battery, motor, and gear train are essentially at the same level and generally level with the wheels to provide the desired low center of gravity; similarly, the chassis, batteries, motor, and gear train do not protrude any appreciable distance below the wheel axles to provide the desired ground clearance between the front wheel and the front-most of the rear wheels.

Now to consider the illustrated embodiment of FIGS. 9 through 13 in further detail. The illustrated arrangement permits a generally faithful presentation of the proportions of a real life cab for an 18 wheel trailer truck. The chassis 10*a* is generally rectangular, having a bottom wall 19*a*, front and rear upright end walls 12*a*, 13*a*, and upright side walls 11*a*. The chassis also includes intermediate wall portions 319*a* which support the electric motor 27*a* as well as the means for holding the batteries 21*a*, 21*a*'. Suitable electrical connectors 22*a*, 24*a* are provided on the chassis for electrically inter-connecting the batteries 21*a*, 21*a*', to the motor through a suitable off/on switch. The chassis also supports at opposite ends a front worm shaft 35*a* and a rear worm shaft 45*a*. The front worm shaft 35*a* carries a front worm 33*a* which meshes with a front worm gear 34*a* fixed to the front wheel axle 36*a*. Suitable front wheels 237*a* are also fixed to the front wheel axle 36*a*. The front worm shaft 35*a* is also fixed to a spur gear 32*a* that meshes with a pinion gear 31*a* mounted on the front end of the motor shaft 283*a*. There is a like pinion 41*a* mounted on the rear end of the motor shaft 283*a* which engages a spur gear 42*a* fixed on the rear worm shaft 45*a*. The rear worm shaft 45*a* also carries a pair of spaced-apart worms 43*a*, 43*a*', which each engage a worm gear 44*a*, 44*a*'. Each of the worm gears 44*a*, 44*a*' is fixed to one of the rear wheel axles 46*a*, 46*a*'. Each of the rear wheel axles has rear wheels 247*a*, 247*a*' secured to it for common rotation.

Thus, each of the wheel axles 36*a*, 46*a*, 46*a*' is positively driven so that the vehicle will be driven forwardly along a supporting surface even if one or even two of the sets of wheels are moved out of contact with that supporting surface.

A suitable cab body 74*a* may be releasibly attached to the chassis. Further, as noted above, by utilizing two 1½ volt AA penlight batteries the RPM of the motor is increased over its RPM utilizing a single AA battery by approximately 2 times. This increased RPM of the motor is geared down to the wheels and produces greater power at the wheels. This is desirably achieved without changing the ratio between the worms and the worm gears, but rather by changing the gear ratio between the spur gears and pinions. Thus in one version the overall gear ratio achieved was 70:1 (as compared to 40:1 in the two axle one-battery version) with the ratio between each pinion and spur gear being 3½:1 (as distinguished from 2:1 in the two-axle one-battery version).

If desired, additional axles might be added for particular configurations or uses of the vehicle. Further, while an extended 18 wheel trailer cab is illustrated, the length of the cab could be varied to depict other models of cab.

Figure 9:
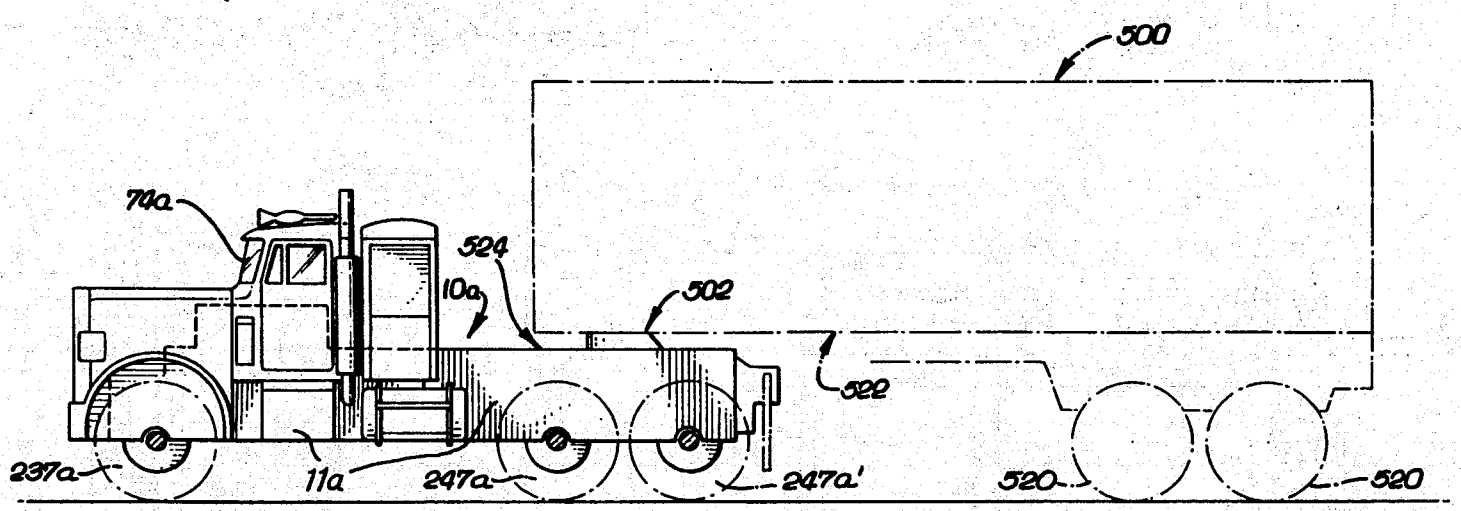
FIG. 9 is a schematic side elevational view of a truck cab and trailer comprising another preferred embodiment of the toy vehicle of the present invention.
Figure 10:
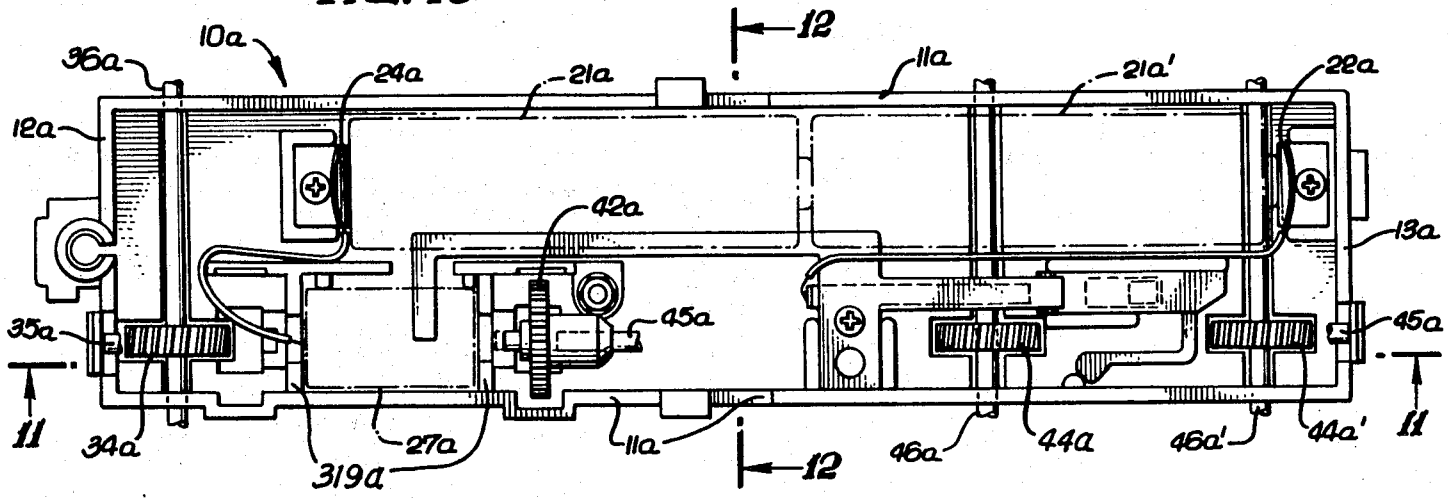
FIG. 10 is an enlarged top plan view of the chassis of the truck cab of FIG. 9.
Figure 13:
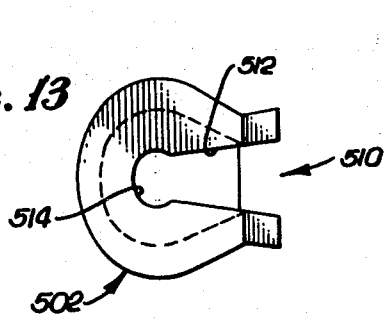
FIG. 13 is a partial plan view of a connector section on the truck cab.
Figure 12:
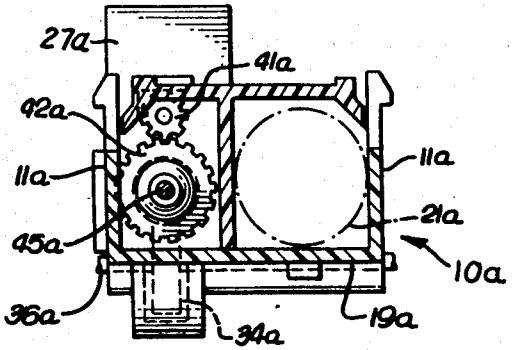
FIG. 12 is a transversed sectional view taken generally along line 12—12 of FIGS. 10 and 11.
Figure 11:
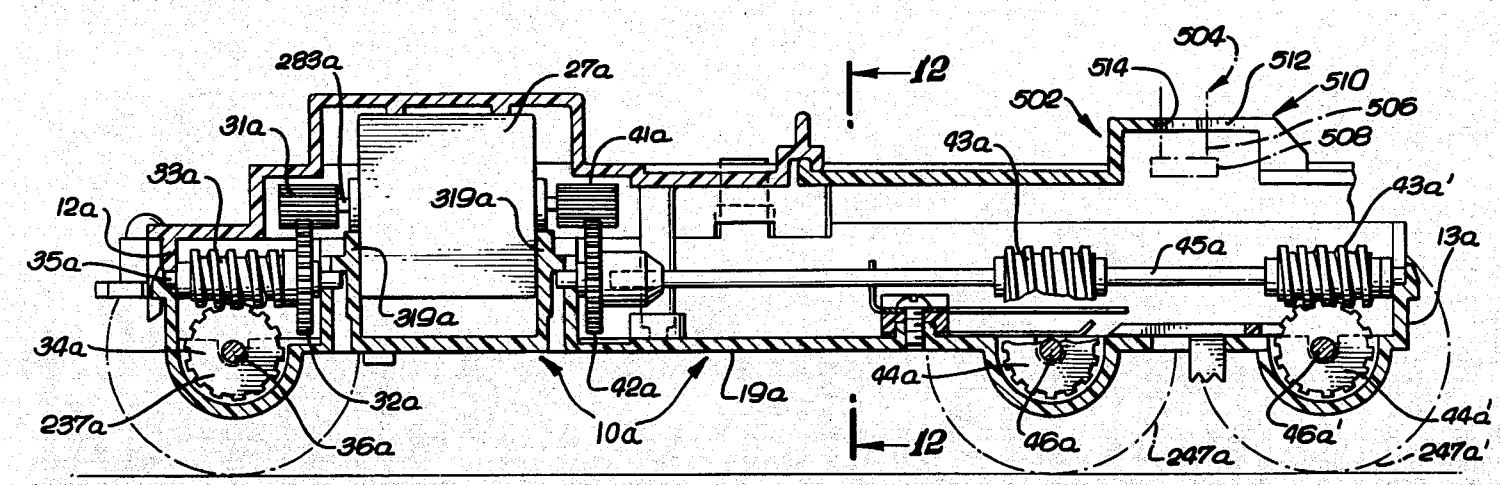
FIG. 11 is a longitudinal sectional view taken generally along line 11—11 of FIG. 10.

FIG. 9 illustrates a truck/trailer section 500 connected to the truck cab. The trailer generally simulates a standard truck trailer having a pair of rear wheel axles and wheels 520 at its rearward end, and being supported at its forward end by the connection described below with the truck cab. In particular, attention is directed to the connector means 502 which comprises a depending pin 504 secured to the underside of the trailer section near its forward end. The pin 504 has a generally cylindrical elongated shank 506 with an enlarged head 508 at its lower end. FIGS. 11 and 13 best illustrate the mating receptacle 510 defined on the flat bed portion of the truck/cab. This receptacle 510 includes a lead-in portion 512 that converges as it extends from the rear toward a main circular opening or portion 514. The elongated shank 506 of the pin extends through the circular portion 514 with the enlarged head 508 being positioned below the lip of the circular portion. This connection permits substantial angular or pivoting movement between the cab and trailer as the vehicle goes over an up-and-down or hilly surface. Such pivoting movement is facilitated by the extra length of the pin which allows the pin to move up and down relative to the circular connector opening. It is also facilitated by the pivoting movement of the pin (in a vertical longitudinal plane) away from an imaginary line that is perpendicular to the plane of the circular connector opening and passes through the center of that opening. Considered in another way, the trailer has a generally horizontal surface 522 and the cab has a generally horizontal surface 524. FIG. 9 shows surfaces 522 and 524 generally aligned and parallel to one another. As pivotal movement occurs between the cab and the trailer, the planes of surfaces 522 and 524 tilt relative to one another. This tilting may produce a smaller angle of up to about 150°; stated another way, the trailer can tilt up to about 30° relative to the cab.

It will be understood that the foregoing disclosure is intended to be merely exemplary, and not to limit the scope of our invention—which is to be determined by reference to the appended claims.

In particular, the invention is not limited to use with four-wheel vehicles. It could alternatively be used in vehicles having certain types of tricycle configuration, or even in a hill-climbing toy motorcycle with side supports.

Further, it is to be noted that while it is presently preferred that the dry-cell battery be a standard AA battery (taking into account size, cost and duration of use), other similar small pen light type batteries might be used. For example, the AAA is slightly smaller but provides a shorter duration of use; the N is substantially smaller but again provides a shorter duration of use; rechargables of the same diameter as the AA, which come in the same and shorter lengths, tend to be more costly.

What is claimed is:

1. An electrically self-powered miniature toy vehicle capable of climbing over rough terrain and obstacles as well as up steep inclines, said vehicle having major weight components positioned to provide weight in a generally balanced and relatively low arrangement while also providing adequate ground clearance in the area between the front and rear wheels, said vehicle comprising:

a frame;

at least three wheel means mounted to the frame for rolling rotation about respective mutually parallel but spaced-apart axes, such axes being in front of each other and there being at least one front axis spaced from at least one rear axis;

an electric motor mounted to one side of the frame between said at least one front axis and said at least one rear axis and having a driveshaft which is perpendicular to the axes and extends both fore and aft from the motor;

means for supporting a pair of AA batteries disposed end-to-end along the other side of the frame and for electrically connecting the batteries to the motor; the batteries and motor being at generally the level of said wheel axes; and the frame, the motor and the batteries not extending appreciably below the level of the axes in the space between said at least one front axis and said at least one rear axis;

three worms mounted parallel to the driveshaft and driven respectively from the fore and aft extensions of the driveshaft; and three worm gears rotatably mounted to the vehicle, with their axes of rotation parallel to the axes of wheel rotation; each worm gear driving a respective one of the said at least three wheel means, and being meshed with and directly driven from a respective one of the three worms.

2. The vehicle of claim 1, also comprising:

a pair of pinions, each mounted directly to a respective one of the two fore and aft extensions of the drive shaft for rotation therewith; and a pair of spur gears, each mounted and secured for rotation with a respective one of the worms and meshed with a respective one of the pinions.

3. The vehicle of claim 2 wherein each of the worm gears is mounted conaxially with a respective one of the wheel means and secured thereto for rotation therewith.

4. The vehicle of claim 3 wherein each of said wheel means are mounted on an axle and each of the worm gears is mounted to the axle of the said respective one wheel means, and both the worm gear and the wheel means are secured against rotation with respect to the corresponding axle.

5. The vehicle of claim 4 wherein each worm rides on a common shaft with its corresponding spur gear, each said common shaft being journalled at both ends in the frame.

6. The vehicle of claim 1 also comprising tires mounted to the wheel means, the tires having a high friction peripheral surface and an extremely exaggerated tread pattern.

7. The vehicle of claim 1 also comprising:

tires mounted to the wheel means; and a toy vehicle body mounted to the frame, said body:

concealing the motor, worms, worm gears and dry-cell mounting means; and being a scale model derived from at least one real vehicle body;

said axes of wheel rotation being spaced apart to generally match the axle spacing of such a real vehicle at the scale used; and the tires being at least one-and-a-half times overscale.

8. The vehicle of claim 7 wherein the scale used is in the range from 45:1 to 60:1.

9. The vehicle of claim 7 wherein the tires are roughly two times overscale.

10. The vehicle of claim 9 wherein the scale used is in the range from 45:1 to 60:1.

11. The vehicle of claim 1, also comprising tires, mounted to the wheel means and made of foam whose cell structure at the periphery of the tires is open to the ambient.

12. The vehicle of claim 1 wherein the mechanical advantage between the motor shafts and their corresponding worm-gear shafts is between about 100:1 and 50:1.

13. The vehicle of claim 12, also comprising tires which are mounted to the wheel means and made of foam whose cell structure at the periphery of the tires is open to the ambient.

14. The vehicle of claim 13, also comprising:

a toy vehicle body mounted to the frame, said body:

concealing the motor, worms, worm gears and dry-cell mounting means; and being a scale model derived from at least one real vehicle body;

said axes of wheel rotation being spaced apart to match the axle spacing of such a real vehicle at the scale used; and said tires being at least one-and-a-half times overscale.

15. The vehicle of claim 14 wherein the tires are roughly two times overscale.

16. The vehicle of claim 15 wherein the torque-to-weight ratio of the vehicle is such as to permit climbing a grade of roughly 40°.

17. The vehicle of claim 15, wherein:

the tires define an extremely exaggerated tread pattern; and the torque-to-weight ratio in combination with the exaggerated tread is such as to permit climbing a vertical step substantially exceeding the front-tire radius.

18. The vehicle of claim 1 in combination with means defining an irregular climbing surface which comprises effective grades exceeding 30°.

19. The vehicle of claim 18 wherein the surface-defining means comprise relatively sharp ridges along two sides of the climbing surface, for restraining the vehicle from leaving the climbing surface.

20. The vehicle of claim 1 wherein:

each of the worms is mounted directly to a respective one of the two fore and aft extensions of the shaft for rotation therewith; and each of the worm gears is mounted conaxially with a respective one of the wheel means and secured thereto for rotation therewith.

21. A miniature electrically self powered toy vehicle capable of climbing over rough terrain and obstacles as well as up steep inclines, said vehicle having its major weight components positioned to provide weight in a generally balanced and relatively low arrangement while also providing adequate ground clearance in the area between the front and rear wheels, said vehicle comprising:

a chassis having an extended rectangular bottom surface and raised walls at both sides, and at front and rear;

six wheels mounted to and secured for rotation with three axles, two wheels to each axle, the axles in turn being mounted in mutual parallelism for rotation generally at said rectangular bottom surface, in such orientation as to permit the toy to roll on the wheels in a direction parallel to the long dimension of the rectangular bottom surface of the chassis; at least one of such axles being near one end of the rectangular bottom surface of the chassis and at least another of the axles being near the other end of the said surface, and furthest apart of said axles being spaced apart by roughly the length of two penlight dry cells each not appreciably over two inches in length;

six tires, one mounted to each wheel, respectively;

an electric motor mounted upon the chassis along one of the side walls and having a driveshaft which is perpendicular to the axles and extends both fore and aft from the motor;

a pair of pinions, each mounted directly to a respective one of the two fore and aft extensions of the shaft for rotation therewith;

a pair of spur gears, each fixed to a respective shaft parallel with but below the motor shaft, and journalled at one end in a respective end wall of the chassis, each of said spur gears meshing with and being directly driven by a respective one of the pinions;

three worms, each fixed to a respective one of the spur gear shafts and secured to the corresponding spur gear for rotation therewith;

three worm gears, each rotatably mounted to a respective one of the said three axles and secured for rotation therewith; each of said worm gears meshing with and being directly driven by a corresponding one of the worms; and means for mounting two small cylindrical dry-cells each not appreciably over two inches long or shorter longitudinally end-to-end upon and within the chassis between the motor and the other one of the side walls, alongside the motor, pinions, spur gears, and worms at generally the same height as the wheels, and wherein said frame, said motor and said dry-cells do not extend any appreciable distance below the level of the front and rear axles in the area between the front wheels and the rear wheels; and means for electrically interconnecting such dry-cells, when mounted to the mounting means, to power the motor.

22. The toy vehicle of claim 21, also comprising:

a toy vehicle body mounted upon the chassis to conceal the motor, worms, worm gears and dry-cell mounting means;

said body being a scale model derived from at least on real vehicle body, at a scale between 45:1 and 60:1;

the aforesaid axles being spaced apart to generally match the axle spacing of such a real vehicle at roughly said scale; and said tires being roughly two times overscale in diameter, made of foam whose cell structure is open to ambient about the tire periphery, and defining extremely exaggerated tread patterns.

23. The miniature toy vehicle of claim 22, wherein:

the mechanical advantage between the motor shafts and their corresponding worm-gear shafts is between about 100:1 and 50:1; and the torque-to-weight ratio in combination with the said tread patterns and tire materials is such as to permit climbing a grade of up to 40°, except on unusually slippery surfaces.

24. The miniature toy vehicle of claim 22, wherein:

the mechanical advantage between the motor shafts and their corresponding worm-gear shafts is between about 100:1 and 50:1; and the torque-to-weight ratio in combination with the said tread patterns and tire materials is such as to permit climbing any grade on which the vehicle does not tip over backwards, except where traction fails.

25. A miniature electrically self-powered toy vehicle capable of climbing over rough terrain and obstacles as well as up steep inclines, said vehicle having major weight components positioned to provide weight in a generally balanced and relatively low arrangement, while also providing adequate ground clearance in the area between the front and rear wheels, said vehicle comprising:

a frame;

front wheel means and rear wheel means fixed to axles mounted to the frame for rolling rotation about respective mutually parallel but spaced-apart front and rear axes, there being at least three axes in total, at least one rear axis and at least one front axis, there being a wheel axle at each axis, the distance between the furthest apart of the front and rear axes being generally about four inches, each of said wheel means having high friction peripheral surfaces with inside edges located respectively adjacent to opposite sides of said frame;

an electric motor mounted to one side of the frame between the front and rear wheel means and located adjacent to said inside wheel edges on said one side of the frame, and having a driveshaft which is perpendicular to the two axes and extends both fore and aft from the motor;

means mounted to the frame to releasably support electrical battery means in the form of a pair of standard cylindrical AA dry-cells at the other side of the frame in a position extending substantially the full distance between said furthest apart front and rear axes and located adjacent to said inside wheel edges on said other side of the frame, with the axes of the battery means substantially parallel to the driveshaft and the battery means being laterally adjacent to the electric motor and at approximately the same height as said front and rear wheel means, and wherein said frame, said motor and said battery means do not protrude any appreciable distance below the level of said front and rear axes in the area between said front and rear wheel means;

means for electrically connecting such battery means, when supported in the supporting means, to the motor, so that the battery means powers the motor;

three worms rotatably mounted parallel to the driveshaft and driven respectively from the fore and aft extensions of the driveshaft; and three worm gears rotatably mounted to the vehicle, with their axes of rotation parallel to the axes of wheel rotation; each worm gear driving a respective one of the said wheel axles, and being meshed with and directly driven from a respective one of the three worms.

* * * * *